United States Patent [19]

Chandler

[11] 3,949,442

[45] Apr. 13, 1976

[54] VACUUM CLEANER HEADS

[76] Inventor: Michael John Chandler, Springfields, Tuddenham Lane, Witnesham, Ipswich, Suffolk, England

[22] Filed: Dec. 26, 1974

[21] Appl. No.: 536,370

[30] Foreign Application Priority Data

Dec. 26, 1973 France ..... 73.47188
Apr. 30, 1974 France ..... 74.15825

[52] U.S. Cl. ..... 15/1.7; 15/415 R
[51] Int. Cl.[2] ..... E04H 3/20
[58] Field of Search ..... 15/1.7, 322, 358, 359, 15/363, 367, 393, 397–402, 415, 410

[56] References Cited

UNITED STATES PATENTS

| | | | |
|---|---|---|---|
| 3,085,267 | 4/1963 | Jacuzzi | 15/1.7 |
| 3,273,188 | 9/1966 | Levack | 15/1.7 |
| 3,360,816 | 1/1968 | Fontecchio | 15/1.7 |

*Primary Examiner*—Edward L. Roberts
*Attorney, Agent, or Firm*—Wood, Herron & Evans

[57] ABSTRACT

A head of a vacuum cleaner of the type adapted for cleaning the floor and walls of pools such as swimming pools by movement of the head over, whilst being slightly spaced from, the floor of the pool whilst subjected to suction, having at least one section of the portion of the head designed to be moved over the floor hingedly connected to another section of that portion.

7 Claims, 2 Drawing Figures

VACUUM CLEANER HEADS

This invention relates to vacuum cleaners for cleaning swimming pools.

Vacuum cleaners normally comprise a head unit which is attached to a hose subjected to suction and which in use is moved over and is slightly spaced from the floor of the pool. Dirt, leaves and the like are then sucked through the gap between the pool bottom and the head, up through the head into the hose and are deposited in a filter device or discharged to waste. The spacing of the head from the floor of the pool is such as to allow adequate suction to be applied to dirt lying on the bottom.

Turbulence is a limiting factor in cleaning times, but if a streamlined head is produced which cuts down turbulence then it suffers from the disadvantage that is cannot be moved close into the angles between the walls and the floor of the average type of swimming-pools.

This problem is overcome by a head of a vacuum cleaner of the type adapted for cleaning the floors and walls of pools such as swimming pools by movement of the head over, whilst being slightly spaced from, the floor of the pool whilst subjected to suction, in accordance with the invention, which has at least one section of the portion of the head designed to be moved over the floor hingedly connected to another section of that portion.

The articulation of one section in relation to another enables one part of the head to in effect fold towards the other when the head reaches a wall so that the corner between the wall and the bottom can be cleaned.

The cleaner is preferably in three sections, a central section to which is fixed a handle and a tube for applying suction to the cleaner, and two sections hingedly mounted one on each side of the central section. The sections are preferably longitudinal, with the axis of the hinges parallel to the lengths of the sections, and perpendicular to the direction in which the cleaner is to be moved when in use. Wheels or rollers may be mounted on each section to aid movement.

Brushes are preferably provided along, for example, the length of the central section, and may additionally be provided on other sections.

Operation of the cleaner is effected by moving it along the bottom of the swimming pool. When a corner is reached the leading section pivots upwardly, riding up the side of the pool, so that the next section can reach the corner. In this way the cleaner effectively follows the contours of the pool, and suction, and a brush is provided, is applied to the corners so that they are cleaned. A side of the pool is then cleaned by pulling the cleaner upwardly, so that the leading section rises, and the following section(s) pivot on their hinges so that all sections now move over the side.

Sealing strips made of, for example, rubber are preferably fixed between adjacent sections, so that the suction does not pull water downwardly through the hinges, which would reduce the efficiency of the cleaning action, and slow down the cleaner.

Preferably the cleaner is designed with a streamlined shape, to increase the speed with which it may be used, and reduce the turbulence which it causes.

An additional way in which turbulence may be decreased, and speed increased is by the provision of flexible flaps extending downwardly along the underside of the head at each side of the section of the head connected to the hose, towards the floor or walls.

When suction is appled to the cleaner, the flaps are sucked slightly inwardly towards each other by the action of the water moving past them. When the cleaner is moved, the leading flap is displaced further inwardly creating a larger gap between the flap and the bottom or side of the pool, because the water is moving past at a faster rate.

Such a gap is however not created between the following flap. This has two effects. First, the positions of the flaps ensure that the suction effectively only pulls in water from the leading section, and does not suck water from the following section, where the pool has already been cleaned. Hence the cleaning is more efficient. Second, because water is not sucked into the following section, against the direction in which the cleaner is travelling, less turbulence is caused by the cleaner. This is important, because turbulence disturbs dirt in the pool, so that use of the pool is delayed until the dirt has settled again.

If the cleaner is to be used in a swimming-pool having corners which are right-angles, and not curved, the cleaner is preferably provided with auxiliary wheels or rollers, fixed on the leading section so that they project in front of the section, and so that they are mounted higher than the axis about which the leading section is pivotted, as the cleaner is moved along the bottom of the pool. When the cleaner reaches the side of the pool, the auxiliary wheels or rollers contact the side. Further movement effects a pivotting of the leading section on its hinge so that the auxiliary wheels or rollers ride up the side, until the leading section itself contacts the side.

After this the leading section rides up the side, followed by the other sections.

The invention will now be further described by way of example with reference to the accompanying drawings in which.

Figure 1:
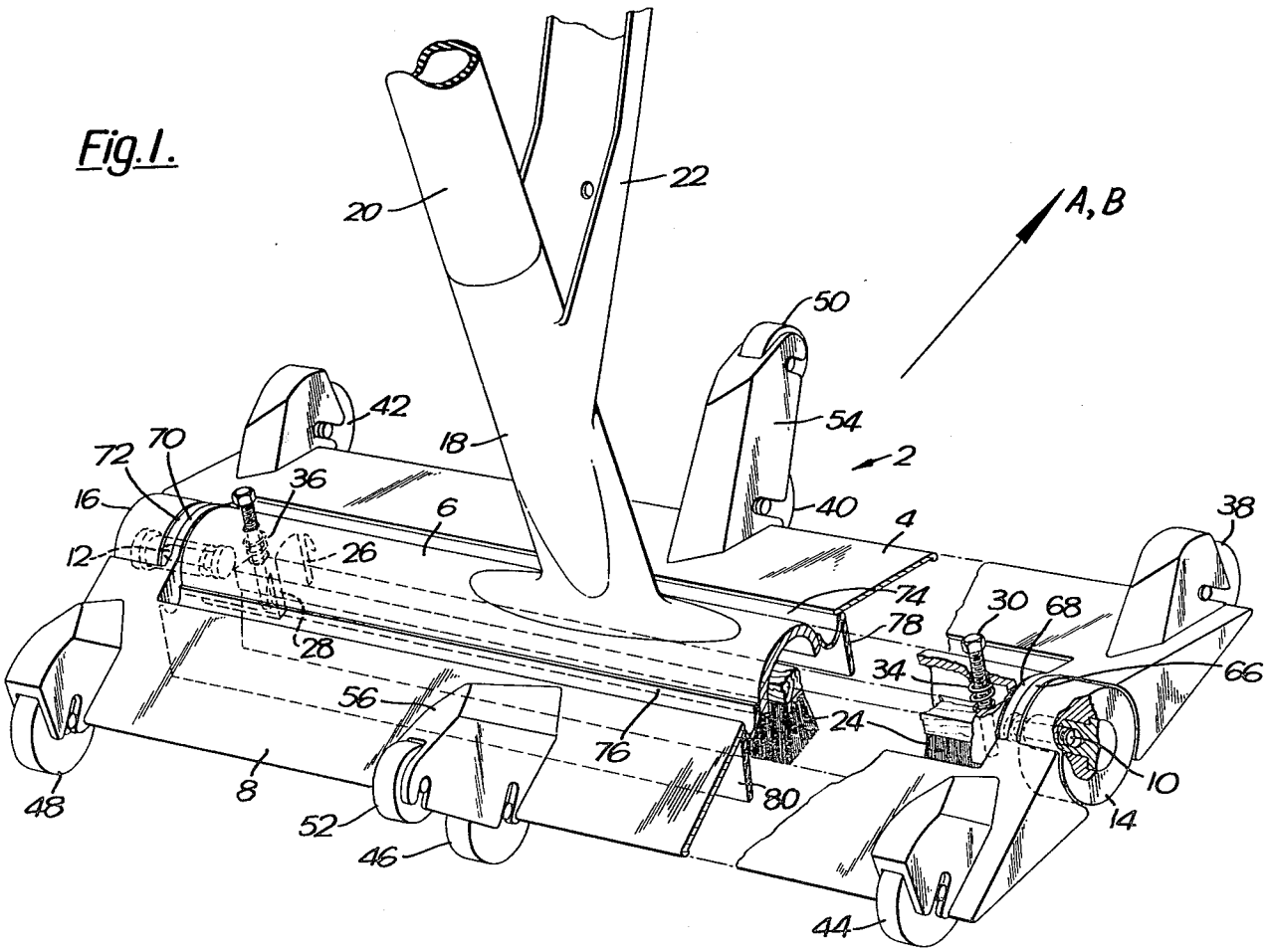
FIG. 1, is a perspective view, partly in section, of a swimming-pool vacuum cleaner head in accordance with the invention.

Referring to FIG. 1, a swimming-pool vacuum cleaner head generally indicated at 2, comprises three sections, 4, 6 and 8, a first head section 6, a second head section 4, and a third head section 8. Sections 4 and 8 are mounted on co-linear stub axles 10 and 12, on which are mounted wheels 14 and 16. A pipe 18 is mounted on the central section 6 for connection to a hose 20 which in turn is connected to a source of suction (not shown). A bracket 22 is mounted on the pipe 18 for attachment to a handle (not shown). A brush 24 is resiliently mounted along central section 6 between brush guides 26, 28 by bolts 30, 32 on which are attached springs 34, 36. Adjustment of the height of the brush 24 is effected by adjusting these bolts 30, 32.

Wheels 38, 40, 42, 44, 46 and 48 are adjustably mounted on sections 4 and 8. The vacuum cleaner head is intended to run on these wheels, which allow freedom of movement, and provide the necessary clearance of the head from the floor or walls of the pool, when the cleaner is in use.

If it is desired to have a device, of say, two clearances of sections 4 and 8 from the bottom and sides of the swimming-pool, these wheels may be mounted on longitudinal brackets (not shown) which have holes offset from the centers of the brackets. The brackets may be fitted in either of two ways, each of which gives a different clearance of the sections 4 and 8 when the axles of the wheels are mounted in the holes.

Auxiliary wheels 50, 52 are mounted on brackets 54, 56 upstanding from the top surfaces of the sections 4 and 8 respectively.

Figure 2:
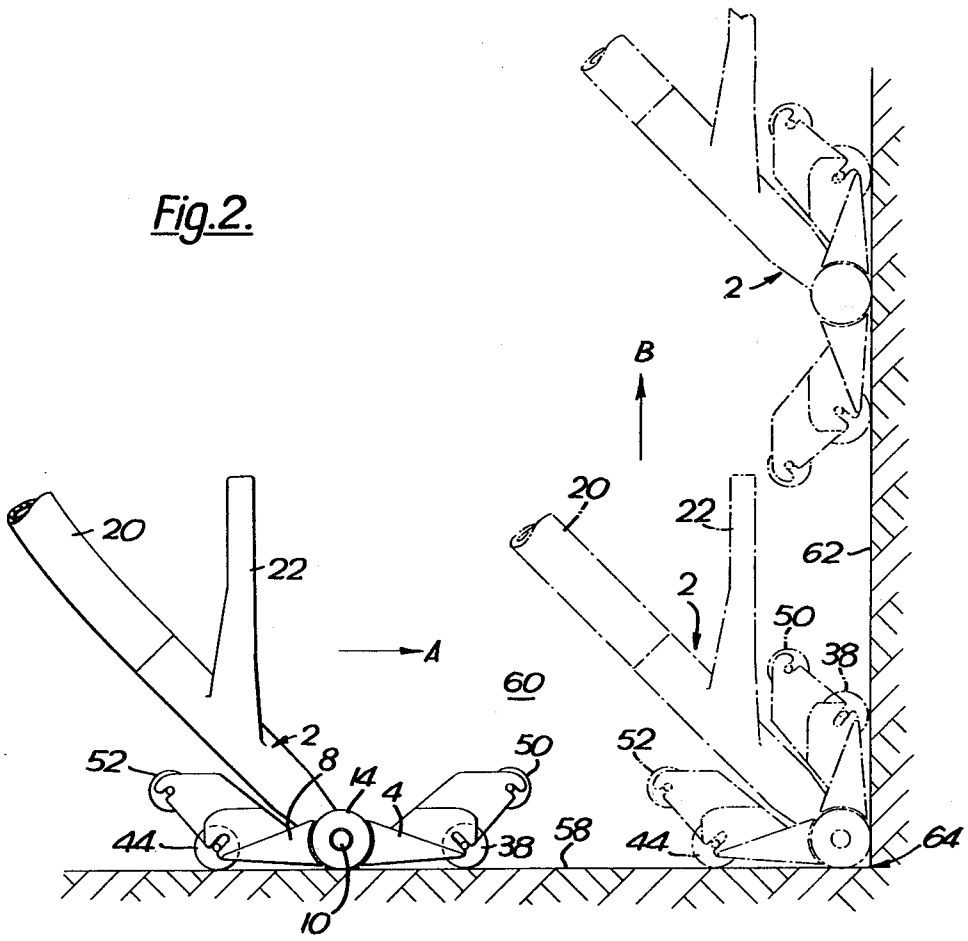
FIG. 2 is a drawing showing three positions of the swimming-pool vacuum cleaner head when in use in a swimming pool.

Referring now to FIG. 2, the cleaner head 2 is shown in solid lines on the bottom 58 of the pool 60. It is moved by means of a handle connected to bracket 22 in the direction of arrow A.

During this movement dirt and leaves and the like on the bottom 58 of the pool 60 are dislodged by the brush 24 and sucked up into the hose 20. They are then disposed of in a known manner. As the cleaner head 2 reaches the side 62 of the pool 60, auxiliary wheel 50 makes contact with the side 62. Further movement causes section 4 to pivot about axis 10 in an anticlockwise direction, as seen in the drawing. Then wheel 38 and wheels 40 and 42 (as shown in FIG. 1) contact the side 62.

The wheels 38, 40 and 42 ride up the wall 62, allowing wheels 14 and 16, and brush 24 to reach close to the corner 64 of pool 60.

The corner is cleaned by the suction action and the brush 24, and the cleaner 2 is then pulled upwardly, in the direction of arrow B. Following section 8 falls downwardly, so that the wheels 44, 46 and 48 ride up the side 62 of the pool 60.

In this way the corners, sides and bottoms of swimming-pools can be cleaned by the vacuum cleaner. Thus the primary travel direction of the vacuum cleaner is shown by the arrow A, B in FIG. 1.

Referring again to FIG. 1, sections 4 and 8 are hingedly attached on axles 10 and 12 by annular brackets 66, 68, 70 and 72. Each section has complementary brackets, so that the two sections are identical in form, which aids manufacture of the cleaner.

Rubber sealing strips 74 and 76 are provided between sections 4 and 6 and 6 and 8 respectively. These flaps prevent water being sucked downwardly through the gaps between sections 4 and 6 and 6 and 8 when the cleaner is in use, and thus increase the effectiveness of the cleaner.

The sealing strips 74 and 76 are formed integrally with flaps 78 and 80, which extend downwardly to a position closely adjacent the floor or walls of the swimming pool when the cleaner is in use. The purpose of flaps 78 and 80 has been described above.

The hinges between adjacent sections need not be of the mechanical type, but may be of solid, flexible material. Such hinges may form the sealing strips between the sections.

It will be appreciated that the vacuum cleaner can clean swimming-pools more efficiently, quicker and with less turbulence than can known cleaners.

I claim:

1. A vacuum cleaner head adapted to clean the floor and walls of a swimming pool, said head comprising a first head section having a vacuum pipe connected thereto between the ends of said first head section, said first head section being adapted to move over the bottom of a swimming pool in a primary travel direction, and a second head section connected to said first said section along a first hinge axis disposed transverse to said primary travel direction, said first hinged connection being along the leading edge of said first head section relative to said primary travel direction, and said second head section being pivotable upward along said first hinge axis to ride up the side wall of said swimming pool as said vacuum cleaner head meets the floor and wall corner of said swimming pool when moving in said primary travel direction, thereby permitting said first head section and vacuum pipe to be positioned in optimum proximity to said corner for cleaning of same as said vacuum cleaner head moves between the bottom and the side wall when moving in said primary travel direction.

2. A vacuum cleaner head as set forth in claim 1 including seal means provided along said first hinge axis, said seal means preventing the flow of water through the hinged connection of said first and second head sections.

3. A vacuum cleaner head as set forth in claim 1 including a third head section connected to said first head section, said third head section being so connected on a second hinge axis transverse to said primary travel direction, and said second hinged connection being along the trailing edge of said first head section relative to said primary travel direction.

4. A vacuum cleaner head as set forth in claim 3 including wheels mounted on each of said head sections to engage the pool bottom and wall surfaces, said wheels being aligned to define said primary travel direction.

5. A vacuum cleaner head as set forth in claim 1 including a brush mounted to said first head section, said brush extending parallel to said first hinge axis and extending downwardly into contact with the pool surface, and said brush being positioned rearwardly of said vacuum pipe relative to said primary travel direction.

6. A vacuum cleaner head as set forth in claim 1 including an auxiliary wheel mounted on said second head section, said auxiliary wheel being upstanding from the section to engage the pool's wall as said vacuum head approaches the pool's wall in said primary travel direction, that auxiliary wheel and wall engagement initiating the upward pivotal motion of said first head section.

7. A vacuum cleaner head as set forth in claim 1 including a flexible flap mounted to said first head section along each of the leading and trailing edges of said first head section, each flap extending downwardly towards the pool's surface.

* * * * *